United States Patent [19]

Puoti

[11] Patent Number: 4,543,904

[45] Date of Patent: Oct. 1, 1985

[54] COLLAPSIBLE ARM ANCHOR

[76] Inventor: Francesco Puoti, Vicolo Posta 52, Reggio Calabria, Italy

[21] Appl. No.: 477,912

[22] Filed: Mar. 23, 1983

[30] Foreign Application Priority Data

Mar. 24, 1982 [IT] Italy ..... 83346 A/82

[51] Int. Cl.[4] ..... B63B 21/34

[52] U.S. Cl. ..... 114/294; 114/298; 114/301; 114/307

[58] Field of Search ..... 114/298, 301, 302, 303, 114/304, 307, 294, 297, 210, 310; 135/20 R, 20 M, 26

[56] References Cited

U.S. PATENT DOCUMENTS

| | | | |
|---|---|---|---|
| 2,084,233 | 6/1937 | Zepa | 114/298 |
| 2,709,980 | 6/1955 | Christie | 114/298 |
| 2,887,980 | 5/1959 | Madden | 114/298 |
| 3,123,037 | 3/1964 | Jensen | 114/298 |
| 4,038,934 | 8/1977 | Thomson | 114/298 |
| 4,057,024 | 11/1977 | Adams | 114/298 |

FOREIGN PATENT DOCUMENTS

| | | | |
|---|---|---|---|
| 231634 | 6/1963 | Austria | 135/20 R |

*Primary Examiner*—Trygve M. Blix
*Assistant Examiner*—Edwin L. Swinehart
*Attorney, Agent, or Firm*—Morgan, Finnegan, Pine, Foley & Lee

[57] ABSTRACT

Self-clearing anchor (10) having one or more arms (13) hinged to the stem (11), in the vicinity of the crown (12) of the anchor (10), cooperating with biassing member (17) to counteract the rotation of the arms (13), the arms being adapted, when subjected to a determined stress, to collapse beyond the crown (112) of the anchor (10). In the anchor, the biassing member (17) can be adjusted by appropriate regulation member (19).

2 Claims, 7 Drawing Figures

COLLAPSIBLE ARM ANCHOR

This invention relates to a novel anchor having collapsible arms, for ships, boats and other watercraft.

More specifically, the present invention relates to a self-clearing anchor having arms which are movable relative to the stock and pivoted at the stock end or top and adapted to be collapsed whenever subjected to a sufficient stress, beyond the anchor top.

The most common anchors are composed of a stock equipped at either end with fixed arms bent towards said stock and each fitted endwise with a fluke which holds at the sea bed and serves to moor the ship.

Anchors are also known which have arms hingedly connected to the stock and which are collapsed when not in use so as to reduce the stowage bulk.

During their active mooring time, said anchors exhibit outstretched spokes, like an umbrella, and these spokes are latched in their outstretched positions by a latching ring which is slipped about the anchor stock and can slide therealong.

It is for this reason that such anchors are sometimes dubbed "umbrella anchors" whereas they actually are fixed arm anchors.

Seamen and sea sportsmen are right well aware of the difficulties which are often met with when heaving a foul anchor, especially when an anchor is caught by a rocky sea bed or by seaweed banks.

In order to ease the heaving of a foul anchor a contrivance is often used, which is known as an anchor buoy consisting of a buoy rope and a buoy at the rope end which is tied to the anchor top or the anchor crown so as to trip a foul anchor easily.

To use an anchor buoy when tripping a foul anchor requires a number of manipulations which might be somewhat time-consuming without, however, offering a full reliability for heaving the anchor.

An objective of the present invention is to provide an anchor which is susceptible to being easily cleared of the sea bottom irrespective of any kind of sea bed and without requiring manipulations or time waste.

Another objective of the present invention is to provide an anchor having a self-clearing action which can be adjusted consistently with the size of the watercraft concerned, the kind of sea bed and the conditions of the sea, wind or marine currents obtaining in the mooring place.

An advantage of the present invention is to have eliminated the hazard of losing an anchor when fouled.

Another advantage of the present invention is the rapidity in heaving a foul anchor.

The result is thus that the present invention is embodied by a self-clearing anchor which is characterized in that it exhibits one or more arms hinged to the stock in the vicinity of the anchor crown and cooperating with biassing means to counteract the rotation of said arms, the latter being capable of being collapsed beyond the anchor crown when subjected to a determined stress.

According to another aspect of this invention, said biassing means are adjustable and are fitted with appropriate regulation means.

An exemplary and nonlimiting embodiment of the invention will be described hereinafter with reference to the accompanying drawings, wherein.

In the drawings, like reference numerals designate like component parts, or functionally equivalent parts.

Figure 1:
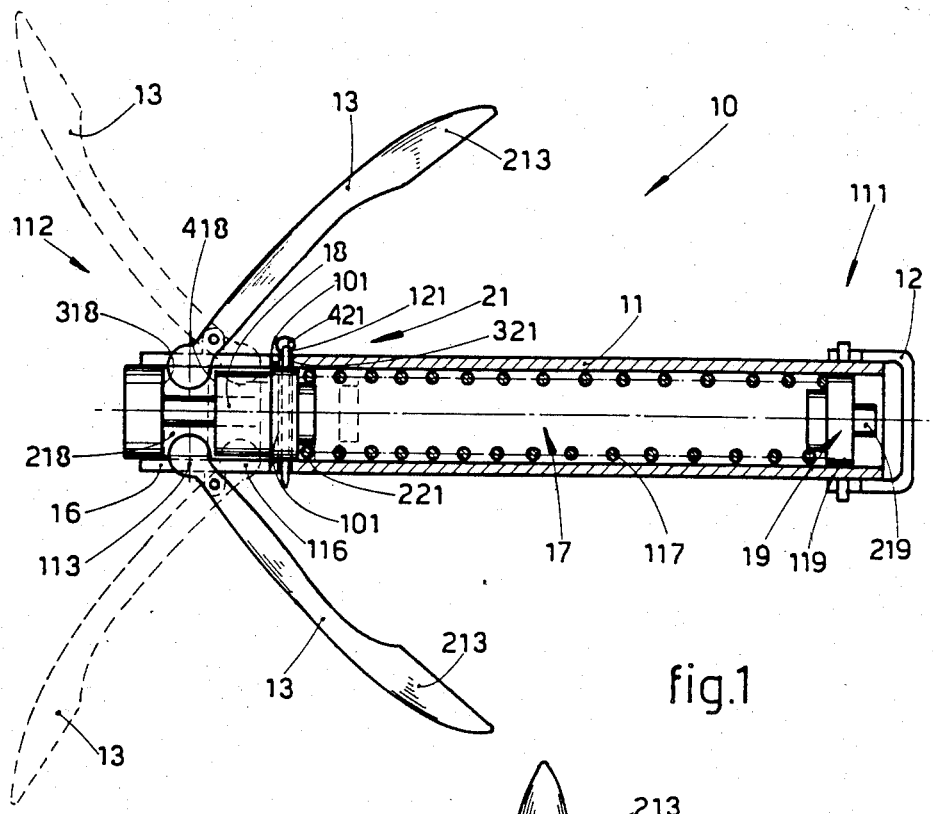
FIG. 1 is a lengthwise cross-sectional view of a preferred embodiment of the invention.
Figure 2:
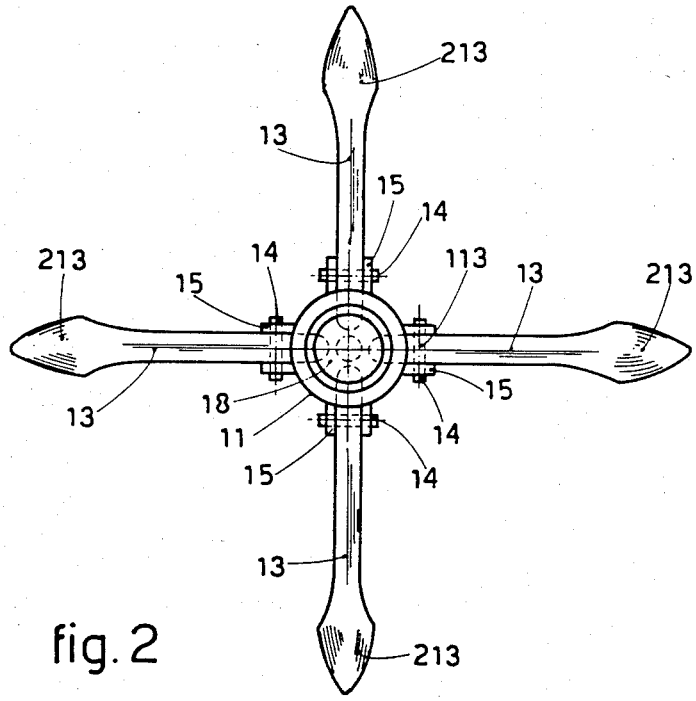
FIG. 2 is a front view of the embodiment of FIG. 1.

Having now reference to FIGS. 1 and 2, an anchor, 10, according to the invention, displays a hollow stem 11 having at its forward end 111 an anchor ring 12 for connection to an anchor rope or an anchor chain, and one or more swingable arms 13 hinged each at 14 into a fork 15 which projects outside the stem 11 in the vicinity of the front end or crown 112.

In correspondence with every arm 13, the hollow stem 11 has, at the end 112 and beneath and centrally relative to the prongs of the fork 15, a longitudinal slot 16 having a width wider that the width of the arm 13.

The slot 16 is terminated by an abutment surface 116.

The length of the slot 16 can be selected so that the abutment surface 116 offers always an abutment stop for the front end 113 of the arm 13, the latter being swingable about the pin 14, when in the position shown in phantom in FIG. 1.

Internally of the hollow stem 11 biassing means 17 are provided to counteract the swing of the arms 13.

In the case in point, said biassing means 17 for counteracting the swinging motion of the arms 13 consist of a helical compression spring 117.

The compression spring 117 cooperates with a body 18 slidably mounted internally of the stem 11 in correspondence with the slots 16 and partially jutting out of the front end 112 of the stem.

An internal ledge 101 provided in the front end 112 of the stem prevents the slidable body 18 from being slipped outwards.

The slidable body 18 cooperates with the front ends 113 of the arms 13.

The end 113 of the arms 13 are shaped and have, with advantage, a spherical outline and are received in a seating 218 formed in the front section of the slidable body 18.

The rear ends 213 of the arms 13 carry the anchor flukes.

The seats 218 prevent the ends 13 of the arms 13 from being separated from the slidable body 18. As a matter of fact, by virtue of the abutting surfaces 318 and 418 of the seat 218, the end 113 of the arm 13 concerned is urged, without exiting the seating, in either direction consistently with the direction of motion of the slidable body 18.

By so doing, the arms 13 can always lie in the equilibrium position which is determined by the foremost position of the slidable body 18.

In order for the arms 13 to be collapsed so as to clear the anchor when the latter is foul, the bias of the spring 117 must be overcome by pulling the anchor rope either by hand or with the aid of the boat or the ship engines, the engines being run ahead or astern as the case may be.

The preload of the biassing means 17 for counteracting the swinging motion of the arms 13, that is to say, the spring 117, is adjusted by appropriate regulation means 19. These means 19 consist, in the example shown herein, of an externally screw-threaded ferrule 119 which is screwably engaged by the partially tapped interior of the rear section 111 of the stem 11.

Ferrule 119 has, advantageously, an external nut 219 which serves for rotating the ferrule with the aid of a socket wrench or any appropriate equivalent means.

Figure 1B:
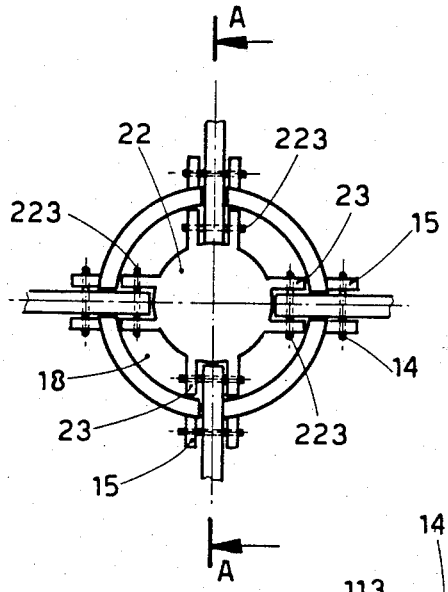
FIG. 1B is a front view of another modification of the anchor crown for the anchor of FIG. 1.
Figure 1C:
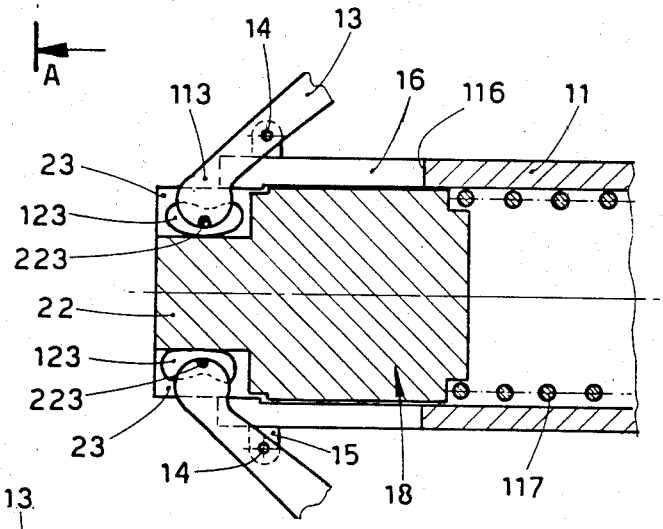
FIG. 1C is a cross-sectional view, taken along the line A—A of FIG. 1B.
Figure 1A:
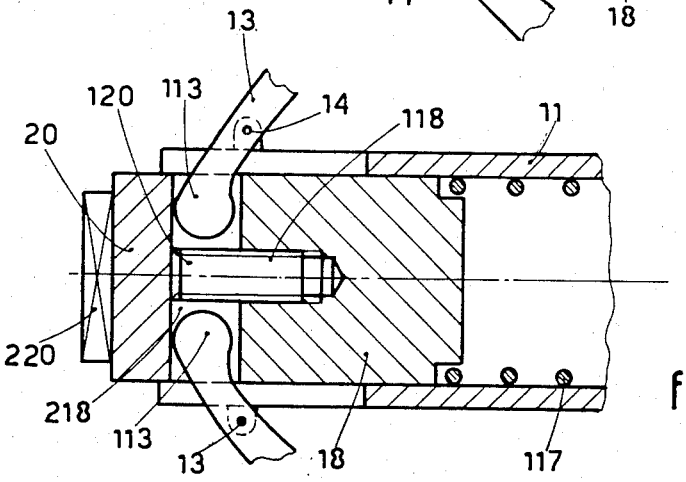
FIG. 1A shows a modification of the crown of the anchor shown in FIG. 1.

To enable the arms 13 to be collapsed during stowage, or for regulating the position of such arms, the slidable body 18 may have an external flange 20 shown in FIG. 1*a*, having a stalk 120 which is externally screw-threaded and is adapted to be screwed into a longitudinal tapped hole 118 formed through the slidable body 18.

The flange 20 may be have a projection 220 to be seized by an appropriate tool to have the flange rotated.

The internal surface of the flange 20, indicated at 21B, cooperates with the forward ends 113 of the arms 13, thus causing the ends 113 to cooperate with the sliding body 18 at any time, because, in this case, the seat 218, whereby the forward ends 113 of the arms 13 are restrained, is length adjustable so as to make possible a certain adjustment of the radial orientation of the arms 13. If the flange 20 is totally removed, the anchor can be stowed with its arms wholly collapsed.

The flange 20 can be tied to the anchor by a chain so as to prevent the flange from going astray during stowage.

As outlined above, in the case of the anchor becoming foul in the sea bottom, it is enough to put the jammed arms under the effect of a twist sufficient to overcome the bias of the spring 117. The arms 13 always return to their equilibrium positions once the twist is released. The magnitude of the twist is obviously a function of the preload of the spring 117, and this can be regulated at leisure prior to dropping the anchor.

For emergency cases, wherein mooring must be reliable and the spontaneous clearing of an anchor is to be prevented, the anchor according to this invention can be fitted with latching means 21 shown by way of example in FIG. 1.

Such latching means 21 consists of a latching pin 121 which can be slipped transversally of the stem 11, so as to be passed through the wall of the stem 11 and through the slidable body 18: the latter has, formed therethrough, a transversal bore 221 formed in registry with a bore 321 drilled through the stem 11.

The latching pin 121 can be attached to the anchor by a chain connected to the ring 421 so as to prevent the pin from being lost.

FIGS. 1*b* and 1*c* show an alternative embodiment of the slidable body 18, in which the ends 113 of the arms 13 are positively connected to said body 18. According to this modification, the slidable body 18 has on its forward section a stepped portion 22 having, in correspondence with each slot 16 formed on the stem, a fork 23 which cooperates with the forward spherical or rounded end 113 of its attendant arm 13 swingable about its own pin 14. The fork 23 has a guiding groove 123 which is transversally oriented.

The end 113 of each arm 13 is provided, at least on a side in the vicinity of the edge, with a side projection 223 which is extended into said groove 123. The size and the shape of the groove 123 are so selected as not to disturb the collapse of the relative arm 13.

The coaction between the projections 223 and the relative guiding grooves 123 prevents the separation of the relative arm 13 from the slidable body 18 and maintains a positive connection between such two component parts.

Figure 4:
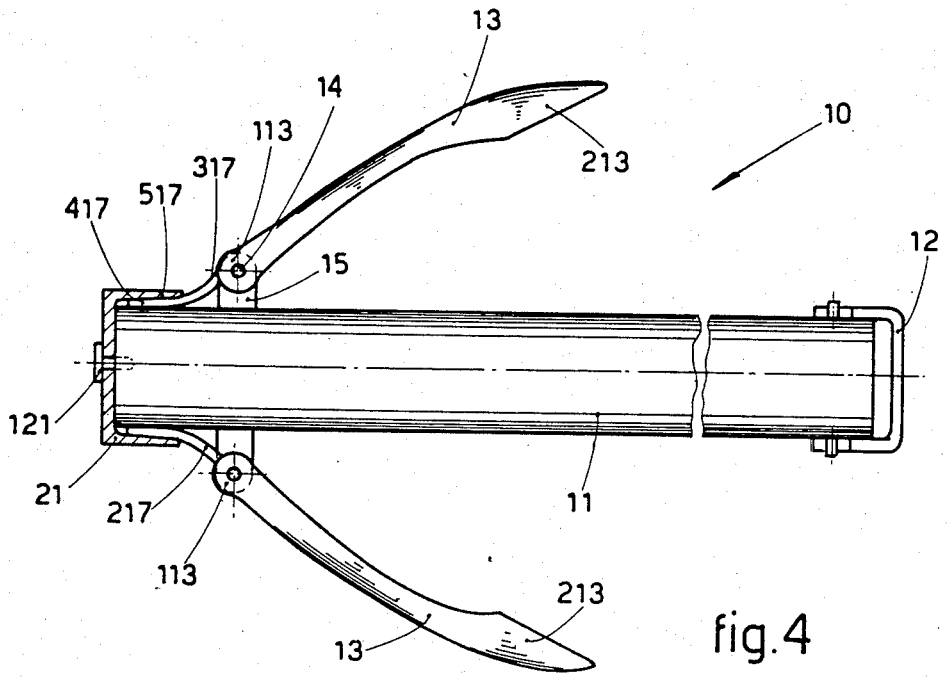
FIG. 4 shows a modified embodiment of the invention based on the modification according to FIG. 3.
Figure 3:
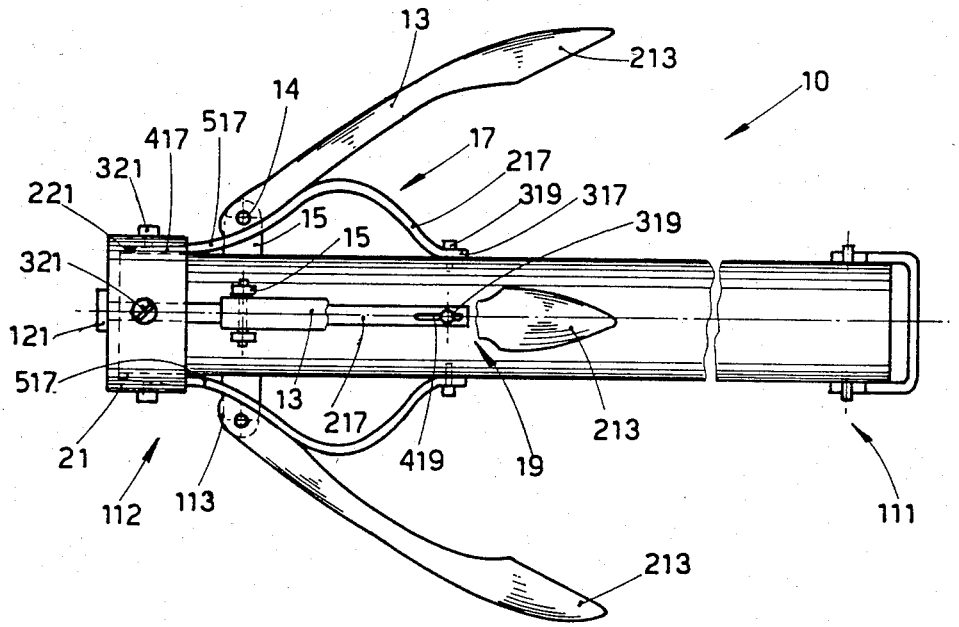
FIG. 3 is a cross-sectional view of another modification of the invention.

In the alternative embodiment shown in FIGS. 3 and 4, the stem 11 is not necessarily hollowed out, but is equally fitted with forks 15 to which are pivoted, at 14, the arms 13 having their front ends 113 radiussed or spherically shaped.

In the example shown herein, FIG. 3, said forward ends 113 coact with biassing means 17 to counter act the rotation movements, said means consisting, each, in the example shown herein, of a leaf spring 217 having an end 317 secured and 319 to the outer surface of the stem 11 and rearwardly relative to the forks 15, and to the forward end 417 freely slidable longitudinally of the stem in a guideway 517 which has been previously formed before the forks 15.

The guideway 517 has an annular outline and is extended longitudinally towards the forks 15.

Such guideway 517 might also be dispensed with: if so, the front ends 417 of the springs can be fastened to the stem 11 by set screws 321. The leaf spring forms a bend having its peak arranged past the pins 14 of the arms 13.

The spherical ends 113 and a portion of the lower edges 313 of the arms always coact with the planar surface of the leaf spring 217 so that the arms 13 are compelled to take an always open equilibrium position as a result of the outline of the leaf spring 217.

Even though the arms 13 are capable of being rotated in the clockwise or counterclockwise direction relative to the transversal plane passing through the pins 14, the arms themselves are nonetheless brought back to the desired equilibrium position once the twist impressed thereto as outlined above in connection with the preferred embodiment has been released.

The longitudinal guideways 517 can be provided by securing to the forward end of the stem 11, for example, a cup shaped sleeve 21 having an inside diameter wider than the outside diameter of the stem 11.

Such sleeve 21 is secured to the stem in an appropriate manner, for example by a bolt 121. By so doing, when the ends 417 of the springs 217 are free, the springs are not only properly guided, but they are also prevented from overtaking the anchor crown by virtue of the abutment stop surface 221 and this fact is of importance for preloading the springs, as will be discussed hereinafter.

FIG. 3 shows, moreover, the means 19 for regulating the preloads for the individual leaf springs 217.

The means 19 for adjusting the spring preload consist, each, of a longitudinal slot 419 formed through the rearward section 317 of the relevant leaf spring 217 and, through said slot, the set screw 319 for securing the spring to the stem is screwed.

To increase the preload for the leaf springs 217, the set screws 319 are first released, the ends 317 of the leaf springs 217 are shifted towards the anchor crown 112 whereafter the screws 319 are tightened so as to latch the spring ends aforesaid in the desired location. The reverse sequence of steps is adopted for reducing the spring preload: however, the ends 317 of the leaf springs 217 should be shifted towards the anchor ring 12.

The modified embodiment of FIG. 4 is a simplification, in practice, of the alternative embodiment of FIG. 3 and exhibits substantially the same component parts with the exception of the presetting of the biassing means 17, that is to say, the leaf spring 217.

According to the embodiment referred to just now, the leaf springs 217 show their rear ends 317 secured to the forward ends 113 of the relative arm 13, the forward end 417 of the leaf spring being, of necessity, free to be moved along the stem 11 and along same and preferably within the guideway 517 fitted with the abutment surface 221 which provides the end of stroke towards the anchor crown for the free end 317 of said springs.

In this case, the cup shaped sleeve 21 serves to prevent the springs 217 from being separated from the stem when the anchor arms are in the normal mooring position as depicted in FIG. 4, but also to protect the users from possible accidents during the manipulation of the anchor.

The invention can be embodied with one or more arms and can be manufactured according to the stocked anchor pattern, the umbrella-like pattern, the plough pattern and otherwise, and the cross-sectional shapes can be round or polygonal.

A preferred embodiment of the invention and a few modifications thereof have been described herein, but other modifications and changes are possible within the purview of anyone skilled in the art without thereby departing from the scope of the present invention.

I claim:

1. A self-clearing anchor comprising a stem having an axial cavity, a plurality of anchor arms pivoted to said stem adjacent to one end of said stem such that said anchor arms have control ends protruding into said cavity and free ends spaced from said stem, an anchor ring rigid with said stem at another end thereof for connection to an anchor pulling cable, a slidable body arranged within said cavity of said stem, and resilient means in said cavity for urging said slidable body against said control ends of said anchor arms, said slidable body and said control ends having mutually cooperating surfaces in permanent engagement with each other, wherein the force of said resilient means against said control ends causes said anchor arms to assume an operative position in which said anchor arms are spread out, wherein a pulling force exerted on said anchor ring causes snagged anchor arms to pivot into a position protruding beyond said one end of said stem against the force of said resilient means, and wherein said slidable body is a cylindrical body having a threaded axial bore and wherein the anchor further comprises a flange having an axial threaded shank threadable into said threaded bore, said flange defining with said body an axially adjustable annular seat for receiving said control ends of said anchor arms.

2. A self-clearing anchor comprising a stem having an axial cavity, a plurality of anchor arms pivoted to said stem adjacent to one end of said stem such that said anchor arms have control ends protruding into said cavity and free ends spaced from said stem, an anchor ring rigid with said stem at another end thereof for connection to an anchor pulling cable, a slidable body arranged within said cavity of said stem, and resilient means in said cavity for urging said slidable body against said control ends of said anchor arms, said slidable body and said control ends having mutually cooperating surfaces in permanent engagement with each other, wherein the force of said resilient means against said control ends causes said anchor arms to assume an operative position in which said anchor arms are spread out, wherein a pulling force exerted on said anchor rings causes snagged anchor arms to pivot into a position protruding beyond said one end of said stem against the force of said resilient means, and wherein said slidable body has a stepped portion opposite to said resilient means and a respective fork secured to said slidable body for each anchor arm, said forks each having a guiding slot for receiving at least one lateral projection of the respective of said anchor arms.

* * * * *